US007841330B2

(12) United States Patent
Liao

(10) Patent No.: US 7,841,330 B2
(45) Date of Patent: Nov. 30, 2010

(54) PAINTBALL GUN

(75) Inventor: Sheng-Jen Liao, Fongyuan (TW)

(73) Assignee: Yao-Gwo Gan, Taichung (TW)

( * ) Notice: Subject to any disclaimer, the term of this patent is extended or adjusted under 35 U.S.C. 154(b) by 112 days.

(21) Appl. No.: 12/367,456

(22) Filed: Feb. 6, 2009

(65) Prior Publication Data

US 2010/0199963 A1 Aug. 12, 2010

(51) Int. Cl.
*F41B 11/00* (2006.01)
*F41B 11/32* (2006.01)

(52) U.S. Cl. ..... 124/77

(58) Field of Classification Search ..... 124/31, 124/32, 71–77, 80
See application file for complete search history.

(56) References Cited

U.S. PATENT DOCUMENTS 7,395,819 B2 * 7/2008 Dobbins et al. ..... 124/71
7,451,755 B2 * 11/2008 Dobbins et al. ..... 124/71
7,617,820 B2 * 11/2009 Jones ..... 124/77
2006/0124118 A1 * 6/2006 Dobbins ..... 124/77
2006/0162716 A1 * 7/2006 Dobbins et al. ..... 124/77
2006/0278206 A1 * 12/2006 Dobbins et al. ..... 124/74
2007/0113836 A1 * 5/2007 Dobbins ..... 124/73
2007/0175465 A1 * 8/2007 Quinn et al. ..... 124/74
2008/0264399 A1 * 10/2008 Dobbins et al. ..... 124/71
2009/0064981 A1 * 3/2009 Dobbins et al. ..... 124/71
2009/0133682 A1 * 5/2009 Dobbins ..... 124/77
2010/0051008 A1 * 3/2010 Lian ..... 124/73
2010/0083944 A1 * 4/2010 Dobbins ..... 124/73
2010/0101550 A1 * 4/2010 Carnall ..... 124/76
2010/0108049 A1 * 5/2010 Dobbins ..... 124/77
2010/0170492 A1 * 7/2010 Tiberius et al. ..... 124/74

* cited by examiner

*Primary Examiner*—Troy Chambers
(74) *Attorney, Agent, or Firm*—Banger Shia

(57) ABSTRACT

A paintball gun includes an air valve and a body portion, in which the body portion includes a paintball hole, a communicator, a piston, an axle sleeve and a bolt. By the pneumatic control of the air valve, the piston is pushed between the first and second positions, and the movement of the bolt is, therefore, controlled between the third and fourth positions, so as to selectively turn the effusion passage open or closed to control the pneumatic air to flow out of the projection passage and projection hole to project the paintball.

6 Claims, 6 Drawing Sheets

PAINTBALL GUN

BACKGROUND OF THE INVENTION

1. Field of the Invention

The present invention relates to a paintball gun with high performance, low air consumption.

2. Description of the Prior Art

The paintball sport has been played for decades and is widely spread around the globe. The paintball gun is the main piece of equipment in the sport of paintball, and it is ameliorated constantly such that it has become a mature technical field.

In a conventional paintball gun, the gun body thereof mainly includes a bolt, some valve assemblies and air passages. Therefore, to further increase the compressed air efficiency and the carry of paintball as well as to reduce the failure rate of paintball gun are still the primary object for the people skilled in this art.

SUMMARY OF THE INVENTION

The main object of the present invention is to provide a paintball gun with high performance, low air consumption.

To achieve the above object, a paintball gun is provided. The paintball gun includes an air valve and a body portion. The body portion includes a paintball hole, a communicator, a piston, an axle sleeve and a bolt.

By the pneumatic control of the air valve, the piston is pushed between the first and second positions, and the movement of the bolt is, therefore, controlled between the third and fourth positions, so as to selectively turn the effusion passage open or closed to control the pneumatic air to flow out of the projection passage and projection hole to project the paintball.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
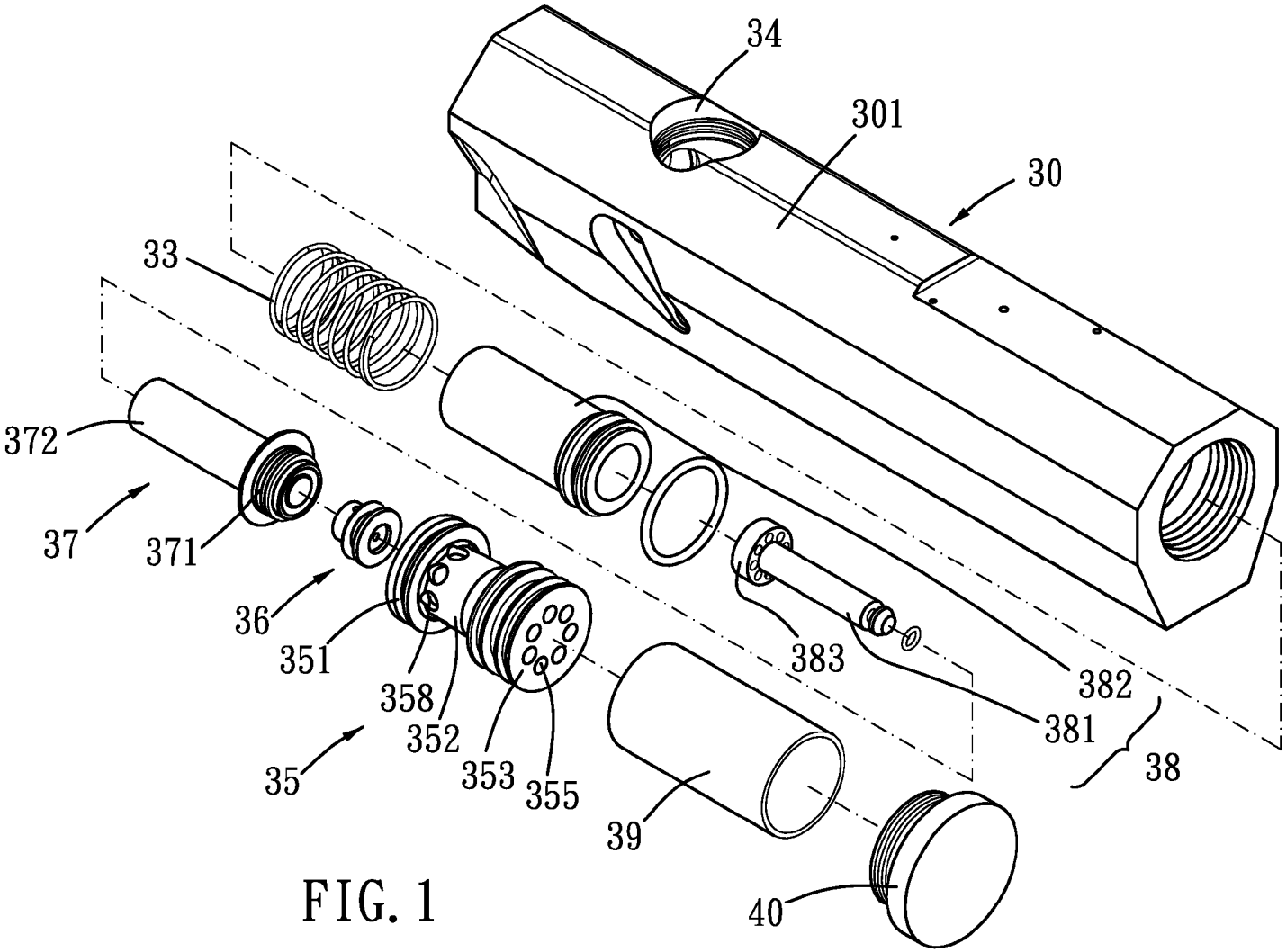
FIG. 1 is a breakdown drawing showing a paintball gun in accordance with a preferred embodiment of the present invention.
Figure 2:
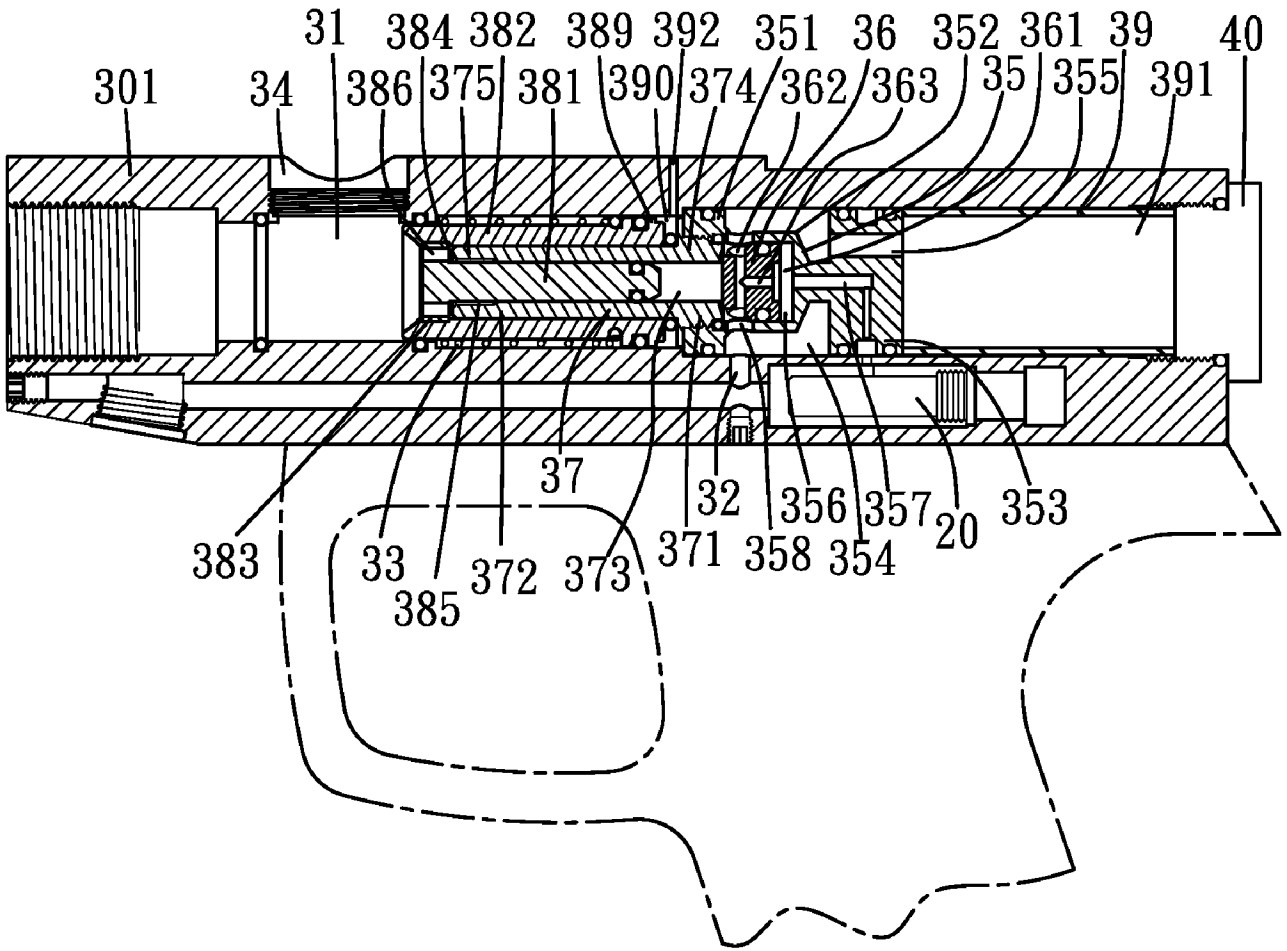
FIG. 2 is a profile showing a paintball gun in accordance with a preferred embodiment of the present invention.

First, please refer to FIG. 1 and FIG. 2. A paintball gun of the present invention includes a pneumatic air source (not shown, will connect to a combining portion 10 if there's any), an air valve 20, a body portion 30, a grip, a trigger (not shown) and a barrel (not shown). One end of the air valve 20 communicates the surrounding, and it is selectively turned open or closed corresponding to the motion of the trigger.

In the present embodiment, the body portion 30 includes a main body 301, which has a hollow receiving room 31 and a first air bore 32. And, the body portion 30 further includes a paintball hole 34, a communicator 35, a piston 36, an axle sleeve 37, a bolt 38, an air storage 39 and a rear cover 40. In addition, the main body 301 further has an inlet communicating with the combining portion 10 so that the inlet is filled with pneumatic air.

The rear cover 40 is fastened to a rear end of the main body 301, while the air storage 39 is installed in the main body 301. An air chamber 391 is defined within the air storage 39. The paintball hole 34 is disposed at a relative front portion of the main body 301 to load a paintball into the receiving room 31 therefrom.

The communicator 35 is disposed in the receiving room 31, and it has a front section 351, a middle section 352 and a rear section 353. An outer diameter of the middle section 352 is smaller than those of the front and rear sections 351, 353, and a first chamber 354 is defined between the middle section 352 and the main body 301. Between the air chamber 391 and the first chamber 354 is axially disposed a first passage 355 which communicates both the air chamber 391 and the first chamber 354, and the first chamber 354 further communicates with the pneumatic air source through the first air bore 32. The communicator 35 further has a receiving space 356 which is disposed axially and rearward from the front section 351. On one end of the receiving space 356 away from the front section 351 is disposed a second passage 357, and at a predetermined position of the middle section 352 is disposed a third passage 358.

The piston 36 is disposed in the receiving space 356, and it is movable between a first position and a second position. Moreover, the piston 36 divides the receiving space 356 into a second chamber 361 and a third chamber 362, and on the piston is disposed a fourth passage 363 which communicates the second and third chambers 361, 362. In addition, the second passage 357 communicates the second chamber 361 with the air valve 20, and the third passage 358 communicates the third chamber 362 with the first chamber 354. Furthermore, a contacting area between the second chamber 361 and the piston 36 is a first surface, and a contacting area between the third chamber 362 and the piston 36 is a second surface, which an area thereof is smaller than that of the first surface.

The axle sleeve 37 has a first end 371 and a second end 372. An air passage 373 is axially disposed through the axle sleeve 37, and a connecting portion 374 is formed on the first end 371 to connect the front section 351 of the communicator 35.

The bolt 38 is movable between a third position and a fourth position, and it includes an inner rod 381 and an outer sleeve 382. An outer diameter of the inner rod 381 is substantially equal to a bore diameter of the air passage 373 such that the inner rod 381 is axially-movably fit in the air passage 373. A bore diameter of the outer sleeve 382 is not smaller than an outer diameter of the axle sleeve 37, and it would be preferred if the bore diameter of the outer sleeve 382 is equal to the outer diameter of the axle sleeve 37. Between the inner rod 381 and the outer sleeve 382 is disposed a linkup 383 so that the inner rod 381 and the outer sleeve 382 are coupled into a linkage relationship. And, the linkup 383 is disposed near one end of the bolt 38 away from the communicator 35. In addition, between the inner rod 381, the outer sleeve 382, the linkup 383 and the axle sleeve 37 is defined a projection passage 384, and between the projection passage 384 and the air passage 373 is disposed an effusion passage 385, which is selectively turned open or closed. Moreover, at least a projection hole 386 is axially penetrating the linkup 383 and communicating the projection passage 384.

Figure 3:
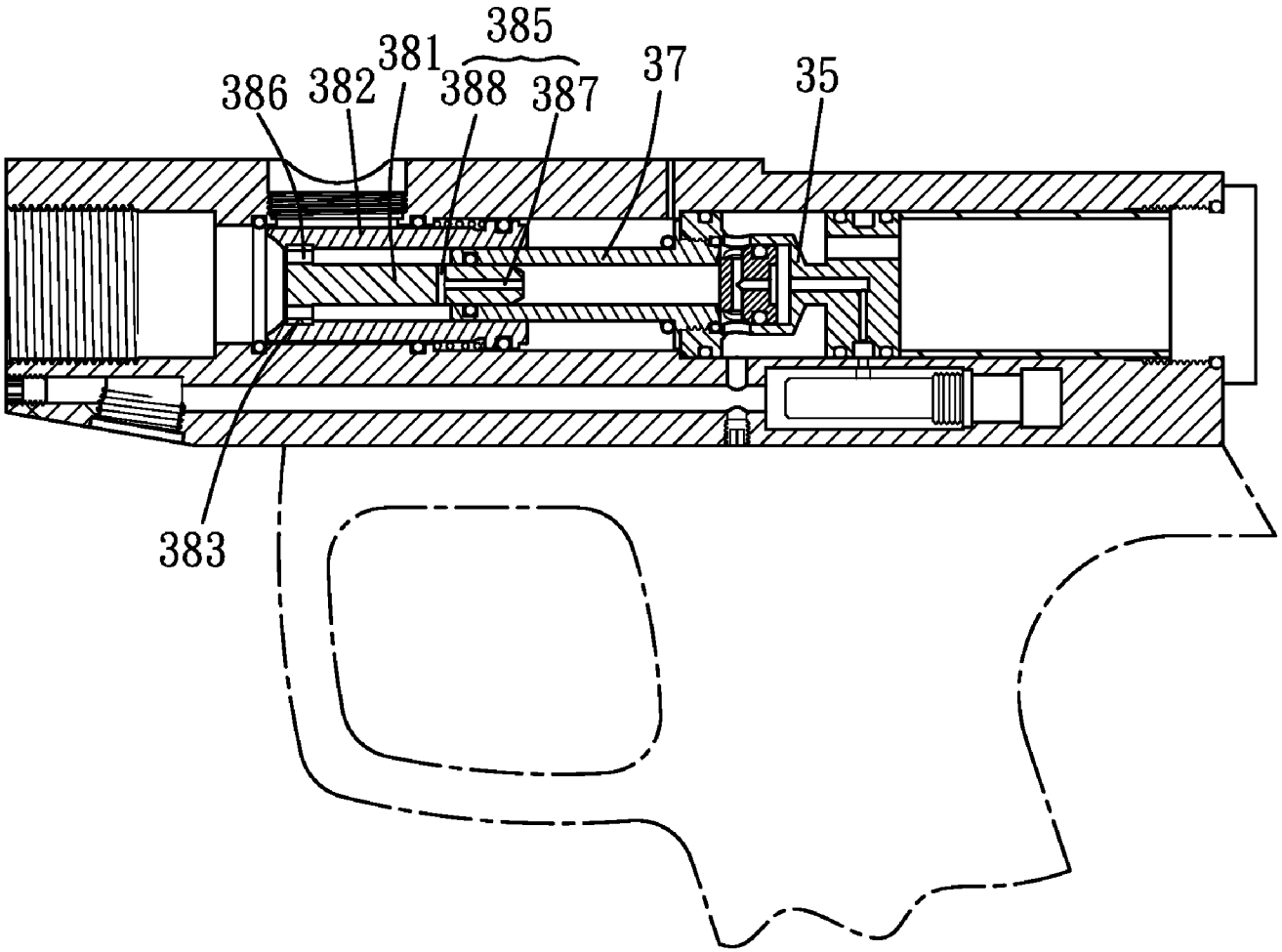
FIG. 3 is a profile showing a paintball gun in accordance with another embodiment of the present invention.

In the present embodiment, the second end 372 of the axle sleeve 37 has an enlarged section 375, in which a bore diameter of the enlarged section 375 is larger than that of the air passage 373. The effusion passage 385 is, therefore, defined between the enlarged section 375 and the inner rod 381. However, the effusion passage 385 can also be designed as shown in FIG. 3, in which the effusion passage 385 includes an axial bore 387 and a radial bore 388. The axial bore 387 is disposed in one end of the inner rod 381 proximate to the communicator 35, and the radial bore 388, communicating with the axial bore 387, is disposed at a predetermined position of the inner rod 381.

Figure 4:
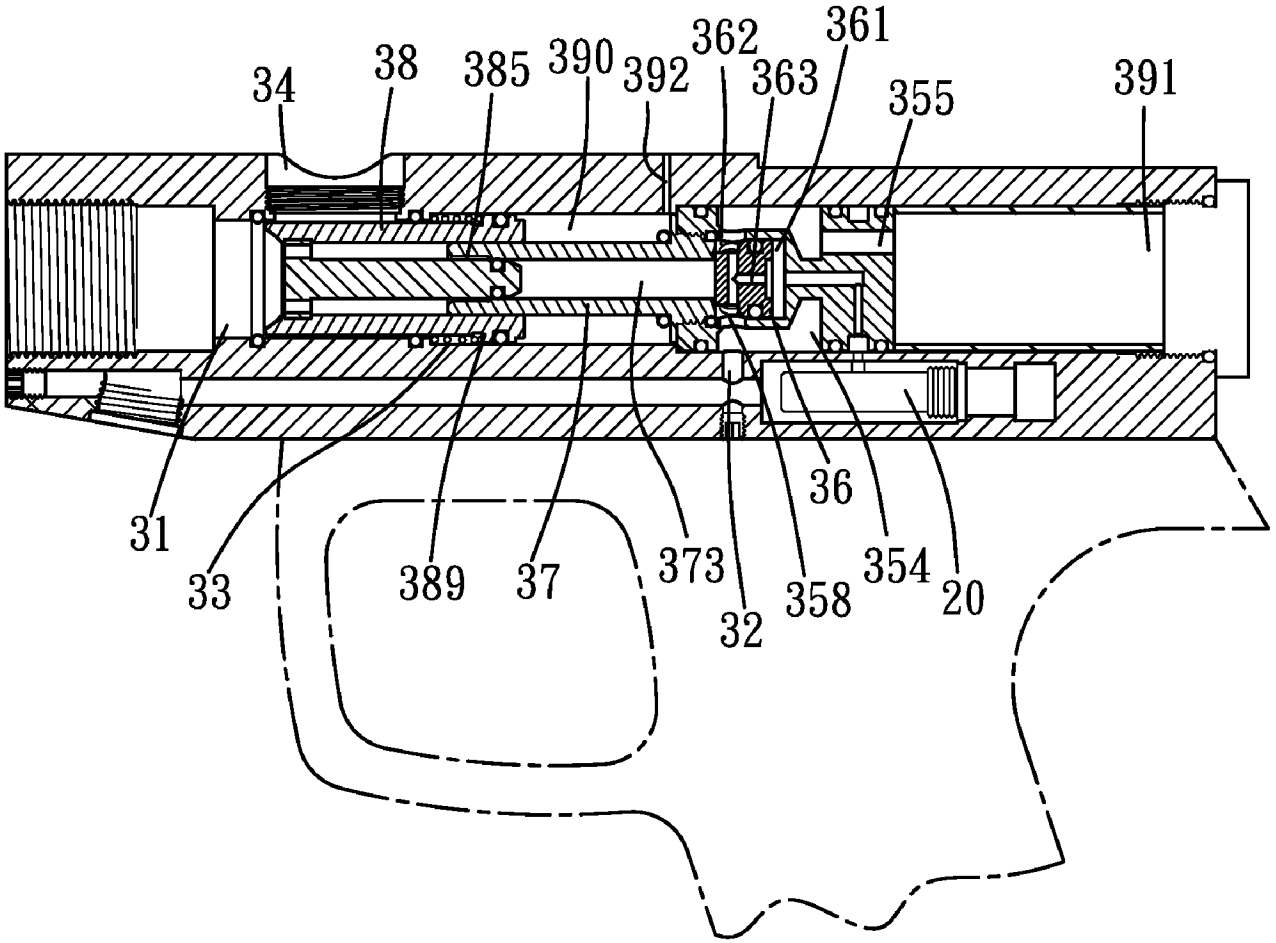
FIG. 4 is a profile showing a pneumatic movement (I) of a paintball gun in accordance with a preferred embodiment of the present invention, in which the air valve is closed.

Please refer to FIG. 2 and FIG. 4. When the air valve 20 is closed, the pneumatic air of the pneumatic air source flows into the first chamber 354 via the first air bore 32, and then the air flows into the air chamber 391 via the first passage 355, into the third chamber 362 via the third passage 358, and into the second chamber 361 via the fourth passage 363. Because the area of the first surface is larger than that of the second surface, the piston 36 is then pushed to the first position and shuts the air passage 373 of the axle sleeve 37. Meanwhile, the bolt 38 is at the third position, shutting the effusion passage 385 and opening the paintball hole 34 for a paintball to drop into the receiving room 31. In the present embodiment, a resilient member is disposed around an outer periphery of the outer sleeve 382, and at a predetermined position of the outer sleeve 382 is formed with an enlarged flange 389, in which one end of the resilient member abuts against the flange 389. In addition, between the flange 389, the axle sleeve 37 and the main body 301 is defined a fourth chamber 390, and at a predetermined position of the main body 301 is disposed a decompression bore 392, which communicates the fourth chamber 390 with the surrounding, such that when the air valve 20 is closed, the bolt 38 is pushed to the third position by the resilience of the resilient member and the air left in the fourth chamber 390 is evacuated to the surrounding from the decompression bore 392.

Figure 5:
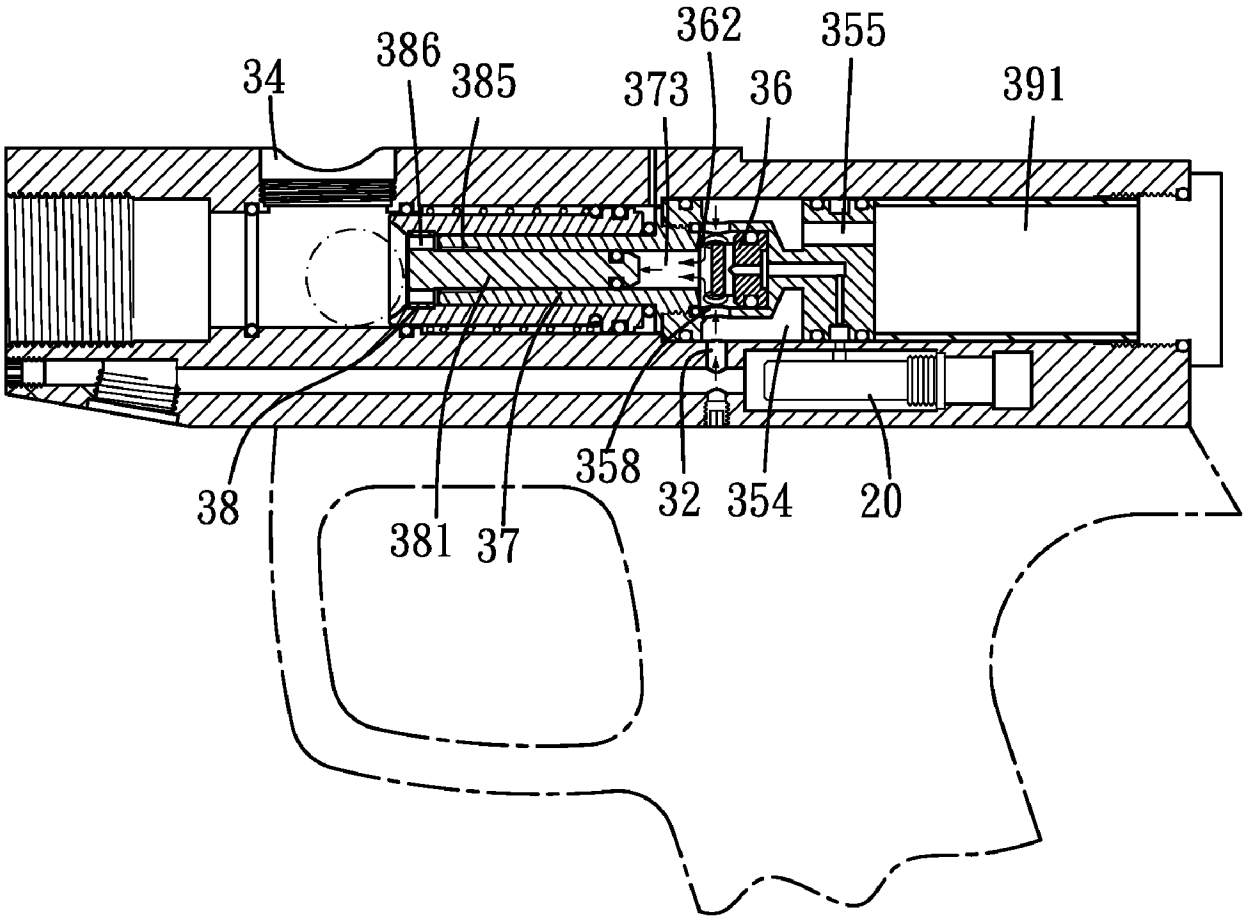
FIG. 5 is a profile showing a pneumatic movement (II) of a paintball gun in accordance with a preferred embodiment of the present invention, in which the air valve is open.
Figure 6:
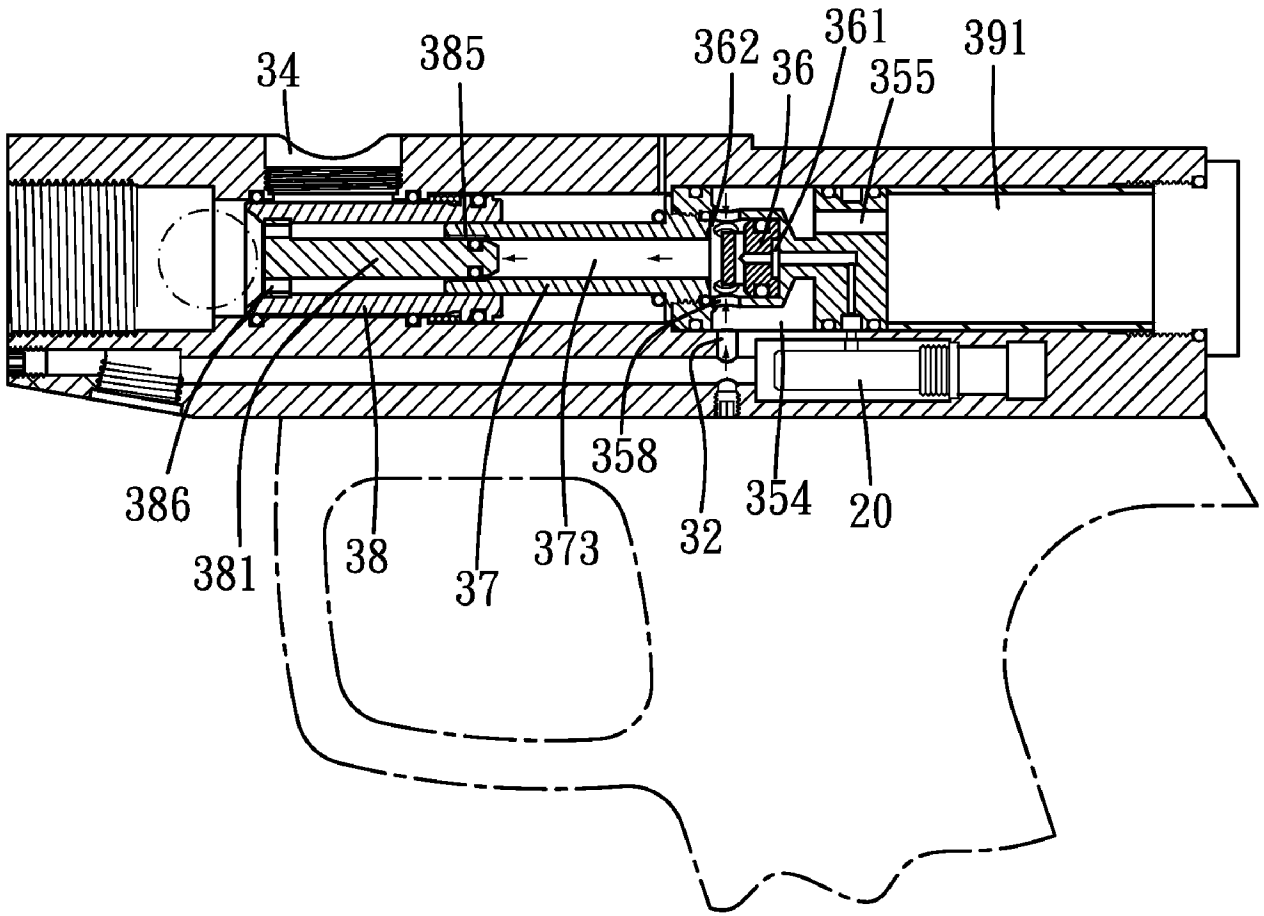
FIG. 6 is a profile showing a pneumatic movement (III) of a paintball gun in accordance with a preferred embodiment of the present invention, in which the air valve is open.

Next, please refer to FIG. 5 and FIG. 6. When the air valve 20 is open, the pneumatic air in the second chamber 361 is evacuated therefrom via the air valve 20, such that the air in the third chamber 362 pushes the piston 36 to the second position, opening the air passage 373 of the axle sleeve 37. At the same time, the air in the first chamber 354 and the air chamber 391 flows into the air passage 373 and then pushes the inner rod 381 so as to further push the bolt 38 to the fourth position and shut the paintball hole 34. Meanwhile, the effusion passage 385 is open for the air to evacuate from the effusion passage 385 and the projection hole 386 so as to project the paintball.

In summary, the paintball gun of the present invention has just a few parts which are relatively easy to be installed than the conventional ones. An air chamber is disposed behind the communicator to provide sufficient and steady air source to increase the projection range of the paintball gun. And, the pull of trigger controls the open/closed of the air valve, so as to further control the movement of both the piston and the bolt, which increases the utilization rate of pneumatic air and streamlines the paintball gun. In addition, the air valve does not involve in the communication between the pneumatic air source and the projection passage as convention art does, which reduces the consumption of air and smoothes the flow of pneumatic air to increase the initial projection speed.

What is claimed is:

1. A paintball gun, comprising:

an air valve, one end thereof communicating a surrounding, and the air valve being selectively turned open or closed; and a body portion, comprising a main body having a hollow receiving room and a first air bore, the body portion further comprising:

a paintball hole, disposed at a predetermined position of the main body and communicating with the receiving room;

a communicator, disposed in the receiving room and having a front section, a middle section and a rear section, between the communicator and the main body being defined a first chamber, the first air bore communicating the first chamber with an inlet; the communicator further having a receiving space, the receiving space being disposed axially and rearward from the front section, on one end of the receiving space away from the front section being disposed a second passage, and at a predetermined position of the middle section being disposed a third passage;

a piston, disposed in the receiving space and being movable between a first position and a second position, the piston dividing the receiving space into a second chamber and a third chamber, and a fourth passage being disposed in the piston, wherein the second passage communicates the second chamber with the air valve, the third passage communicates the third chamber with the first chamber, and the fourth passage communicates the second chamber with the third chamber; moreover, a contacting area between the second chamber and the piston being a first surface, and a contacting area between the third chamber and the piston being a second surface, while an area of the first surface being larger than that of the second surface;

an axle sleeve, having a first end and a second end, an air passage being axially disposed through the axle sleeve, a connecting portion being formed on the first end to connect the front section of the communicator; and a bolt, being movable between a third position and a fourth position, the bolt comprising an inner rod and an outer sleeve, an outer diameter of at least a part of the inner rod being substantially equal to a bore diameter of the air passage such that the inner rod being axially-movably fit in the air passage, a bore diameter of the outer sleeve being not smaller than an outer diameter of the axle sleeve, between the inner rod and the outer sleeve being disposed a linkup so that the inner rod and the outer sleeve being coupled into a linkage relationship, the linkup being disposed close to one end of the bolt away from the communicator, between the inner rod, the outer sleeve, the linkup and the axle sleeve being defined a projection passage, between the projection passage and the air passage being disposed an effusion passage, the effusion passage being selectively turned open or closed, at least a projection hole being axially penetrating the linkup and communicating the projection passage;

wherein, when the air valve is closed, air in the inlet flows into the first chamber via the first air bore, and then the air flows into the third chamber via the third passage and flows into the second chamber via the fourth passage, the piston is then pushed to the first position and shuts the air passage of the axle sleeve because the area of the first surface is larger than that of the second surface, meanwhile, the bolt is at the third position, shutting the effusion passage and opening the paintball hole for a paintball to drop into the receiving room;

wherein, when the air valve is open, the air in the second chamber is evacuated from the second chamber via the air valve, such that the air in the third chamber pushes the piston to the second position, opening the air passage of the axle sleeve, at the same time, the air in the first chamber flows into the air passage and then pushes the inner rod so as to further push the bolt to the fourth position and shut the paintball hole, meanwhile, the effusion passage is open for the air to evacuate from the projection passage and the projection hole so as to project the paintball.

2. The paintball gun of claim 1, wherein the second end of the axle sleeve has an enlarged section, a bore diameter of the enlarged section is larger than that of the air passage, and the effusion passage is defined between the enlarged section and the inner rod.

3. The paintball gun of claim 1, wherein an axial bore is disposed in one end of the inner rod proximate to the communicator, at a predetermined position of the inner rod is disposed a radial bore communicating with the axial bore, and the effusion passage comprises the axial bore and the radial bore.

4. The paintball gun of claim 1, wherein a resilient member is disposed around an outer periphery of the outer sleeve, at a predetermined position of the outer sleeve is formed with an enlarged flange, one end of the resilient member abuts against the flange, such that when the air valve is closed, the bolt is pushed to the third position by the resilience of the resilient member.

5. The paintball gun of claim 4, wherein between the flange, the axle sleeve and the main body is defined a fourth chamber, at a predetermined position of the main body is disposed a decompression bore communicating the fourth chamber with the surrounding.

6. The paintball gun of claim 1, wherein the main body further comprises an air storage, the air storage abuts the rear section of the communicator, an air chamber is defined within the air storage, and between the air chamber and the first chamber is disposed a first passage which communicates the air chamber and the first chamber;

wherein, when the air valve is closed, the air in the first chamber also flows into the air chamber via the first passage;

wherein, when the air valve is open, the air in the air chamber also flows into the air passage to push the inner rod.

* * * * *